US012774066B2

(12) United States Patent
Shiue

(10) Patent No.: US 12,774,066 B2
(45) Date of Patent: Oct. 27, 2026

(54) BREATHABLE MASK, AND STRUCTURE OF ITS BODY

(71) Applicant: QBAS CO., LTD., Taipei (TW)

(72) Inventor: Chih-Cheng Shiue, Taipei City (TW)

(73) Assignee: QBAS CO., LTD., Taipei City (TW)

( * ) Notice: Subject to any disclaimer, the term of this patent is extended or adjusted under 35 U.S.C. 154(b) by 730 days.

(21) Appl. No.: 18/128,677

(22) Filed: Mar. 30, 2023

(65) Prior Publication Data

US 2023/0312067 A1 Oct. 5, 2023

Related U.S. Application Data

(60) Provisional application No. 63/480,348, filed on Jan. 18, 2023, provisional application No. 63/326,418, filed on Apr. 1, 2022.

(51) Int. Cl.
*B63C 11/16* (2006.01)

(52) U.S. Cl.
CPC ..... *B63C 11/16* (2013.01); *B63C 2011/165* (2013.01)

(58) Field of Classification Search
CPC ..... B63C 11/00; B63C 11/02; B63C 11/12; B63C 11/16; B63C 11/18; B63C 11/20; B63C 11/205; B63C 11/207; B63C 2011/165; A62B 18/00; A62B 18/02
See application file for complete search history.

(56) References Cited

U.S. PATENT DOCUMENTS

| | | | | |
|---|---|---|---|---|
| 1,139,850 | A * | 5/1915 | Conkle | B63C 11/205 128/206.28 |
| 6,668,823 | B1 * | 12/2003 | Liu | B63C 11/16 128/201.27 |
| 10,556,654 | B2 | 2/2020 | Cucchia | |
| 11,358,012 | B2 | 6/2022 | Palmieri | |
| 2004/0226563 | A1 * | 11/2004 | Xu | A62B 18/02 128/206.23 |
| 2007/0199565 | A1 * | 8/2007 | Ball | B63C 11/205 128/201.27 |
| 2019/0023366 | A1 * | 1/2019 | Liao | B63C 11/205 |
| 2019/0118918 | A1 * | 4/2019 | Xiao | B63C 11/14 |
| 2019/0224506 | A1 * | 7/2019 | Palmieri | A62B 18/10 |
| 2020/0115015 | A1 * | 4/2020 | Sang | B63C 11/16 |

(Continued)

FOREIGN PATENT DOCUMENTS

| | | | |
|---|---|---|---|
| CN | 204871538 | U | 12/2015 |
| CN | 208979080 | U | 6/2019 |
| CN | 112043022 | A | 12/2020 |

(Continued)

*Primary Examiner* — Colin W Stuart
(74) *Attorney, Agent, or Firm* — MUNCY, GEISSLER, OLDS & LOWE, P.C.

(57) ABSTRACT

A breathable mask has a body including a main frame, a lens and a waterproof sealing skirt. The waterproof sealing skirt has a partition, which divides the interior of the body into an upper chamber and a lower chamber. A bridge is provided to further divide the lower chamber into a nasal chamber and a mouth chamber under the nasal chamber. When the user puts on the mask, his/her nose and mouth are accommodated in the nasal chamber and the mouth chamber, respectively. The nasal chamber and the mouth chamber are capable of being in fluid communication through the bridge.

6 Claims, 9 Drawing Sheets

(56) References Cited

U.S. PATENT DOCUMENTS

| | | | |
|---|---|---|---|
| 2020/0307749 | A1 | 10/2020 | Xiao |
| 2021/0086882 | A1 | 3/2021 | Grimaldi et al. |

FOREIGN PATENT DOCUMENTS

| | | | |
|---|---|---|---|
| EP | 3517808 | A1 | 7/2019 |
| KR | 102014250 | B1 | 8/2019 |
| WO | WO9803225 | A1 | 1/1998 |
| WO | WO2012044113 | A2 | 4/2012 |

* cited by examiner

BREATHABLE MASK, AND STRUCTURE OF ITS BODY

CROSS-REFERENCES TO RELATED APPLICATIONS

This patent application claims the benefits of U.S. Prov. Ser. No. 63/326,418 filed on Apr. 1, 2022, and No. 63/480,348 filed on Jan. 18, 2023. All of the above applications are incorporated by reference herein.

BACKGROUND OF THE INVENTION

Field of the Invention

The present invention is a full-face mask, particularly a breathable mask for snorkeling.

Descriptions of the Related Art

In order to allow a user's mouth and nose to breathe freely, the user to inhale clean air as much as possible, and the dirty air exhaled from the user to be not mixed with clean air when entering the next inhalation cycle, the mask body of the current full face snorkel mask (FFSM) is divided into an upper chamber that covers the user's eyes and a lower chamber that covers the user's mouth and nose, so that the inhaled clean air can unidirectionally flow through the upper chamber into the lower chamber. Most of the dirty air as exhaled from the user can be discharged through an independent exhaust passage. Portions the above-mentioned exhaust passages is independently installed on the periphery of the upper chamber and communicated with the breathing tube, so that the discharged air can directly go to the outside through the breathing tube and will not stay in the upper chamber. This way, the dirty air is not inhaled again and flows into the lower chamber in the user's next inhalation, thereby avoiding carbon dioxide to be contained in the fresh air of the next inhalation cycle. Some patents such as U.S. Pat. No. 10,556,654B2 and U.S. Pat. No. 11,358,012B2 have disclosed such a spatial arrangement.

However, every cycle of inhalation and exhalation, it is inevitable that a certain amount of dirty air rich in carbon dioxide will be left in the exhaust passage and the lower chamber. That amount of dirty air will be inhaled together with clean air in the next inhalation cycle. Therefore, although there is a separate structure for the air intake and exhaust, the air inhaled in each breathing cycle is still not clean enough. After a long time of snorkeling, a considerable amount of carbon dioxide will also accumulate in the mask. In addition, when the mask is actually used in water, it is inevitable that water will accumulate in the lower chamber. Because both of the user's mouth and nose share the same chamber, when the user exhales forcefully through the mouth, hoping to have the accumulated water drain from the purge valve, the water will splash back to the nostrils. This makes the user very uncomfortable, even causes the user to have the feeling of choking on water. Therefore, such masks still have a lot of room for improvement.

In addition, the existing FFSM must overcome the strong water pressure because it must be drained through the purge valve in the water, which is almost impossible in reality. Therefore, it is also impossible to remove the accumulated water in the mask only by the user exhaling forcefully in the water. To resolve the problem, it is often necessary to raise the head or stand up to keep the mask out of the water, and let the accumulated water drain off downward through the purge valve (which is located corresponding to the position of the user's chin). This is extremely inconvenient and consumes energy, and also brings less fun of snorkeling.

In view of this, simultaneously or partially solving the above-mentioned problems, that is, making the shunting of entering clean air and discharging dirty air more reliable, effectively controlling manufacturing and assembly costs, and/or enhancing the strength of the overall mask, have/has become the unanimous goal of the industry.

SUMMARY OF THE INVENTION

An object of the present invention is to provide a breathable mask, which is provided with a bridge in the lower chamber that accommodates the user's mouth and nose. This way, the lower chamber is further divided into a nasal chamber and mouth chamber, wherein the intake air flow is guided to the nasal chamber, the exhaust air flow is guided from the nasal chamber or the mouth chamber. In addition, the nasal chamber and the mouth chamber are conditionally communicated with each other, by providing an opening or openings, or by providing a one-way valve on the opening(s) only allowing fluid to flow from the nasal chamber to the mouth chamber. Meanwhile, the lower chamber is originally an independent cavity. Because of setting the bridge, the lower chamber has been greatly strengthened in structure, so that at the front of the mask, in the mouth and nose area below the lens does not need to consider setting too many hard parts, such as the bracket connecting the lens frame and purge valve frame. The strength of the entire mask is still sufficient, and the soft covering portion will not collapse under water pressure during use.

As to the path of the inhalation airflow, when the nose inhales, fresh air can enter the nasal chamber from the intake conduit, and directly enter the user's nasal chamber; when the mouth inhales, fresh air can enter the nasal chamber from the intake conduit, then enters the mouth chamber and then the user's mouth. Regarding the path of exhalation airflow, if the exhaust passage is communicated with the nasal chamber, when the nose exhales, part of the dirty air will pass through the exhaust passage and be discharged to the outside, and the other part of the dirty air will enter the mouth chamber and then be discharged to the outside through the purge valve. When the mouth exhales forcefully, the dirty air will be discharged into the water through the purge valve and will not return to the nasal chamber because of being blocked by the one-way valve of the bridge. If the exhaust passage is communicated with the mouth chamber, when the nose exhales, the dirty air will enter the mouth chamber first, most part of which will pass through the exhaust passage and be discharged to the outside, and the other small part of which may be discharged into the water through the purge valve. When the mouth exhales, most part of the exhaled dirty air will be discharged through the exhaust passage, and small part of it will be discharged into the water through the purge valve, and will not return to the nasal chamber. Therefore, such a design will have the user inhale and exhale freely through the nose or mouth. If the user chooses to inhale through the nose, because the inhalation airflow is completely independent from the exhalation airflow, the user will be able to inhale almost 100% fresh air; and if the user chooses to inhale through the mouth, because the volume of the mouth chamber is relatively small, the accumulated dirty air in the mouth chamber is also greatly reduced, so as not to replace the large amount of fresh air coming from the nasal chamber through the bridge.

According to the above objective, the present invention specifically provides a breathable mask, comprising a body and at least one breathing tube. The breathing tube is in fluid communication with the interior of the body. The at least one breathing tube includes an intake conduit and an exhaust conduit independent of the intake conduit. The body includes: a main frame; a lens fitted in the main frame; a waterproof sealing skirt at least partially fitted with the main frame and the lens. The waterproof sealing skirt is suitable for fitting on the face of a user; wherein the waterproof sealing skirt has a partition to separate the interior of the body into an upper chamber and a lower chamber. When the user puts on the breathable mask through a fastening device, the partition is seated on the user's nose, the user's eyes are accommodated in the upper chamber, and the user's nose and mouth are accommodated in the lower chamber. An intake passage is formed from the intake conduit of the breathing tube to the lower chamber, and an exhaust passage is formed from the lower chamber to the exhaust conduit of the breathing tube. The invention is characterized in that the waterproof sealing skirt also includes a bridge formed across the lower chamber to divide the lower chamber into a nasal chamber and a mouth chamber below the nasal chamber. When the user puts on the mask, the user's nose is accommodated in the nasal chamber and the user's mouth is accommodated in the mouth chamber, whereas the intake passage is in fluid communication with the nasal chamber, and the exhaust passage is in fluid communication with the mouth chamber or the nasal chamber. Furthermore, the nasal chamber and the mouth chamber can be in fluid communication with each other through the bridge.

Further according to the above-mentioned objective, the present invention specifically provides a structure of the body of a breathable mask. The structure includes: a main frame; a lens, embedded in the main frame; and a waterproof sealing skirt, at least partially connected to the main frame Fitting with the lens. The waterproof sealing skirt is suitable for fitting on the face of a user; wherein the waterproof sealing skirt has a partition, which separates the interior of the body into an upper chamber and a lower chamber. When the user wears the breathable mask, the partition is seated on the user's nose, the user's eyes are accommodated in the upper chamber, and the user's nose and mouth are accommodated in the lower chamber. The structure is characterized in that the waterproof sealing skirt further includes a bridge formed across the lower chamber to divide the lower chamber into a nasal chamber and a mouth chamber below the nasal chamber. When the user puts on the mask, the user's nose is accommodated in the nasal chamber, the user's mouth is accommodated in the mouth chamber, and the nasal chamber and the mouth chamber are suitably in fluid communication with each other through the bridge.

DESCRIPTION OF THE PREFERRED EMBODIMENT

Figure 1:
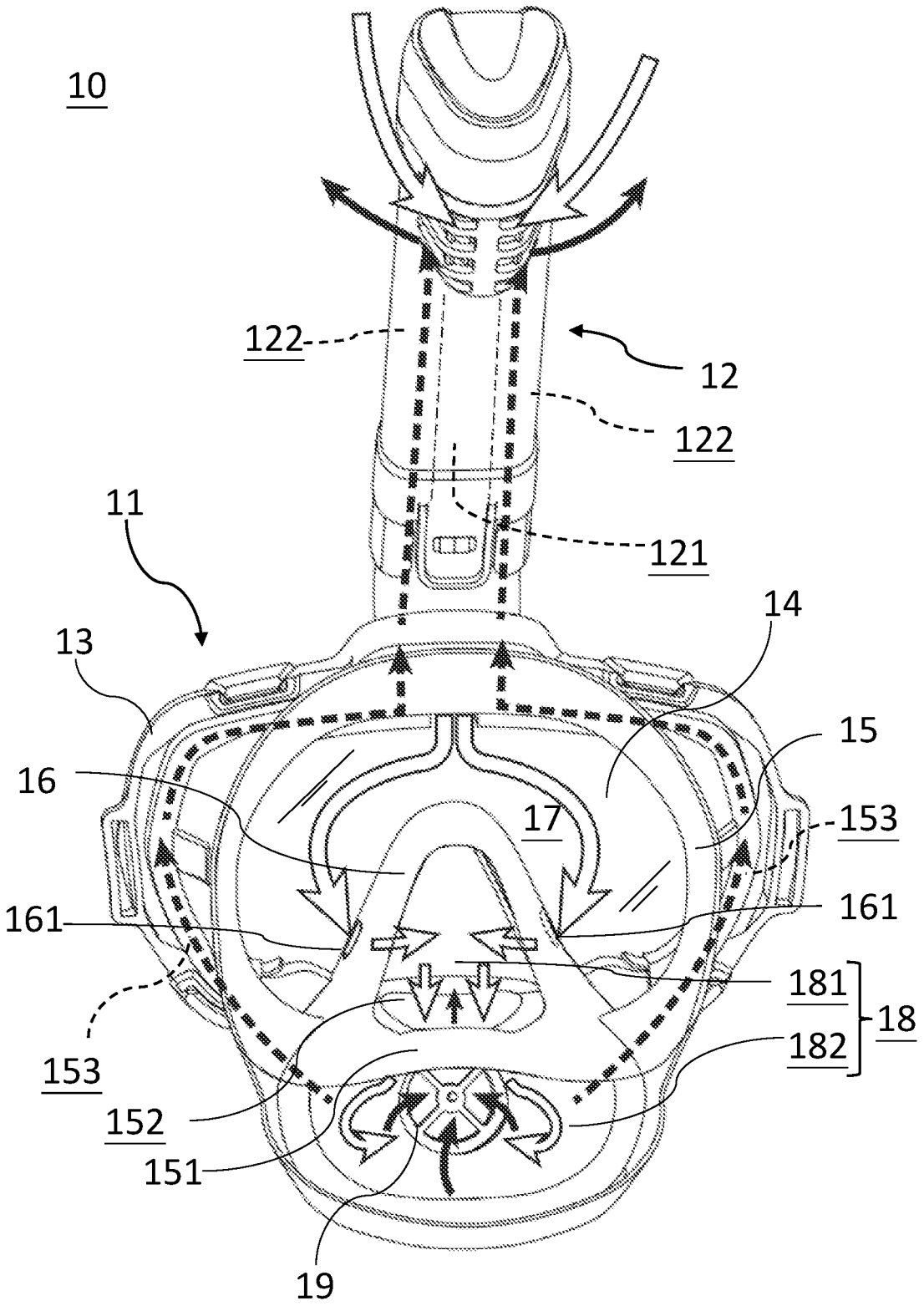
FIG. 1 is the airflow schematic diagram of the first embodiment of the present invention.

The following is the common structure of various embodiments, so the reference numerals corresponding to each figure are systematically listed in parallel. Among them, the elements in the first, second, third, fourth and fifth embodiments are named by the numerals starting with the digits 1, 2, 3, 4 and 5, respectively, in order for clarity and conciseness.

In reference to FIGS. 1 through 5C, a breathable mask 10, 20, 30, 40, 50 includes a body 11, 21, 31, 41, 51, and at least one breathing tube 12, 22, 32, 42, 52 being in fluid communication with an interior of the body 11, 21, 31, 41, 51. This at least one breathing tube 12, 22, 32, 42, 52 comprises an intake conduit 121, 221, 321, 421, 521, and an exhaust conduit 122, 222, 322, 422, 522 independent of the intake conduit 121, 221, 321, 421, 521. The body 11, 21, 31, 41, 51 includes: a main frame 13, 23, 33, 43, 53, a lens 14, 24, 34, 44, 54 fitted in the main frame 13, 23, 33, 43, 53, a waterproof sealing skirt 15, 25, 35, 45, 55 being at least partially fitted with the main frame 13, 23, 33, 43, 53 and the lens 14, 24, 34, 44, 54. The waterproof sealing skirt 15, 25, 35, 45, 55 is suitable for fitting on a user's face (not shown). The waterproof sealing skirt 15, 25, 35, 45, 55 has a partition 16, 26, 36, 46, 56, which divides the interior of the body 11, 21, 31, 41, 51 into an upper chamber 17, 27, 37, 47, 57 and the lower chamber 18, 28, 38, 48, 58. When the user wears the breathable mask 10, 20, 30, 40, 50 through a fastening device (usually an elastic head strap connecting two sides of the main frame 13, 23, 33, 43, 53, not shown in the figures), the partition 16, 26, 36, 46, 56 is seated on the user's nose, the user's eyes are accommodated in the upper chamber 17, 27, 37, 47, 57, and the user's nose and mouth are accommodated in the lower chamber 18, 28, 38, 48, 58. An intake passage is formed from the intake conduit 121, 221, 321, 421, 521 down to the lower chamber 18, 28, 38, 48, 58, and an exhaust passage is formed from the lower chamber 18, 28, 38, 48, 58 up to the exhaust conduit 122, 222, 322, 422, 522. The above-mentioned lens, intake conduit, exhaust conduit, intake passage and exhaust passage are all picked just one for description, but the number of each of them is not limited. Preferably, the lens is an integrated type for left and right eyes, and there are two intake conduits, two exhaust conduits, two intake passages and two exhaust passages, being arranged symmetrically.

The waterproof sealing skirt 15, 25, 35, 45, 55 also includes a bridge 151, 251, 351, 451, 551, disposed across the lower chamber 18, 28, 38, 48, 58, so that the lower chamber 18, 28, 38, 48, 58 is divided into a nasal chamber 181, 281, 381, 481, 581 and a mouth chamber 182, 282, 382, 482, 582 located below the nasal chamber 181, 281, 381, 481, 581. When the user wears the mask 10, 20, 30, 40, 50, the user's nose is accommodated in the nasal chamber 181, 281, 381, 481, 581, and the user's mouth is accommodated in the mouth chambers 182, 282, 382, 482, 582. The intake passage is in fluid communication with the nasal chamber 181, 281, 381, 481, 581, and the exhaust passage is in fluid communication with the mouth chamber 182, 282, 382, 482, 582 or the nasal chamber 181, 281, 381, 481, 581. The nasal chamber 181, 281, 381, 481, 581 and the mouth chamber 182, 282, 382, 482, 582 are suitable for being in fluid communication with each other through the bridge 151, 251, 351, 451, 551.

FIG. 1 is a schematic illustration of the first embodiment of this invention. Specifically, the mask 10 includes a breathing tube 12 with the intake conduit 121 and the exhaust conduit 122 formed inside the breathing tube 12. The intake passage is provided with a first one-way valve 161, which provides inhalation air to enter from the upper chamber 17 toward the nasal chamber 181 unidirectionally. Preferably, the first one-way valve 161 is located on the partition 16, and more preferably, a second one-way valve (not shown) can be provided on the exhaust passage to ensure that the exhaled air is unidirectionally discharged through the exhaust passage from the lower chamber 18, and to further prevent the dirty air accumulated in the exhaust passage from flowing back into the mouth chamber 182.

In this embodiment, the exhaust passage communicates with the mouth chamber 182. The bridge 151 is provided with at least one opening 152 (however, the number and shape of the openings are not limited). When the user puts on the mask 10, fluid communication between the nasal chamber 181 and the mouth chamber 182 can only be performed through the opening 152. As shown by the hollow airflow lines of FIG. 1, when the nose inhales, fresh air will enter from the intake conduit 121 of the breathing tube 12, pass through the upper chamber 17, and enter the nasal chamber 181 through the first one-way valve 161 for the user's nose to inhale; when the mouth inhales, the fresh air in the nasal chamber 181 will enter the mouth chamber 182 through the opening 152 provided on the bridge 151, for the user's mouth to inhale. Further as shown by the solid airflow lines of FIG. 1, when the nose exhales, the dirty air will first enter the mouth chamber 182 through the opening 152, then pass through the exhaust tunnel 153, and goes outside through the exhaust conduit 122 provided in the breathing tube 12, wherein the exhaust tunnel 153 can be, for example, jointly defined by the waterproof sealing skirt 15 and the periphery of the lens 14. When the mouth exhales, the dirty air will be discharged along the exhaust tunnel 153 and the exhaust conduit 122 provided in the breathing tube 12. And when the mouth exhales heavily, because of the barrier of the bridge 151, the accumulated water in the mouth chamber 182 will be discharged through the purge valve 19, and will not splash back into the nasal chamber 181 in large quantities, thereby making the nose area relatively dry and comfortable. Therefore, the user can freely use the nose or mouth to inhale or exhale. Moreover, because the space of the mouth chamber 182 is very small, more preferably, because the position of the design of the purge valve 19 can face the user's mouth, this design can allow the user to overcome the water pressure and easily drain water without needing to surface, thereby saving energy.

Figure 2:
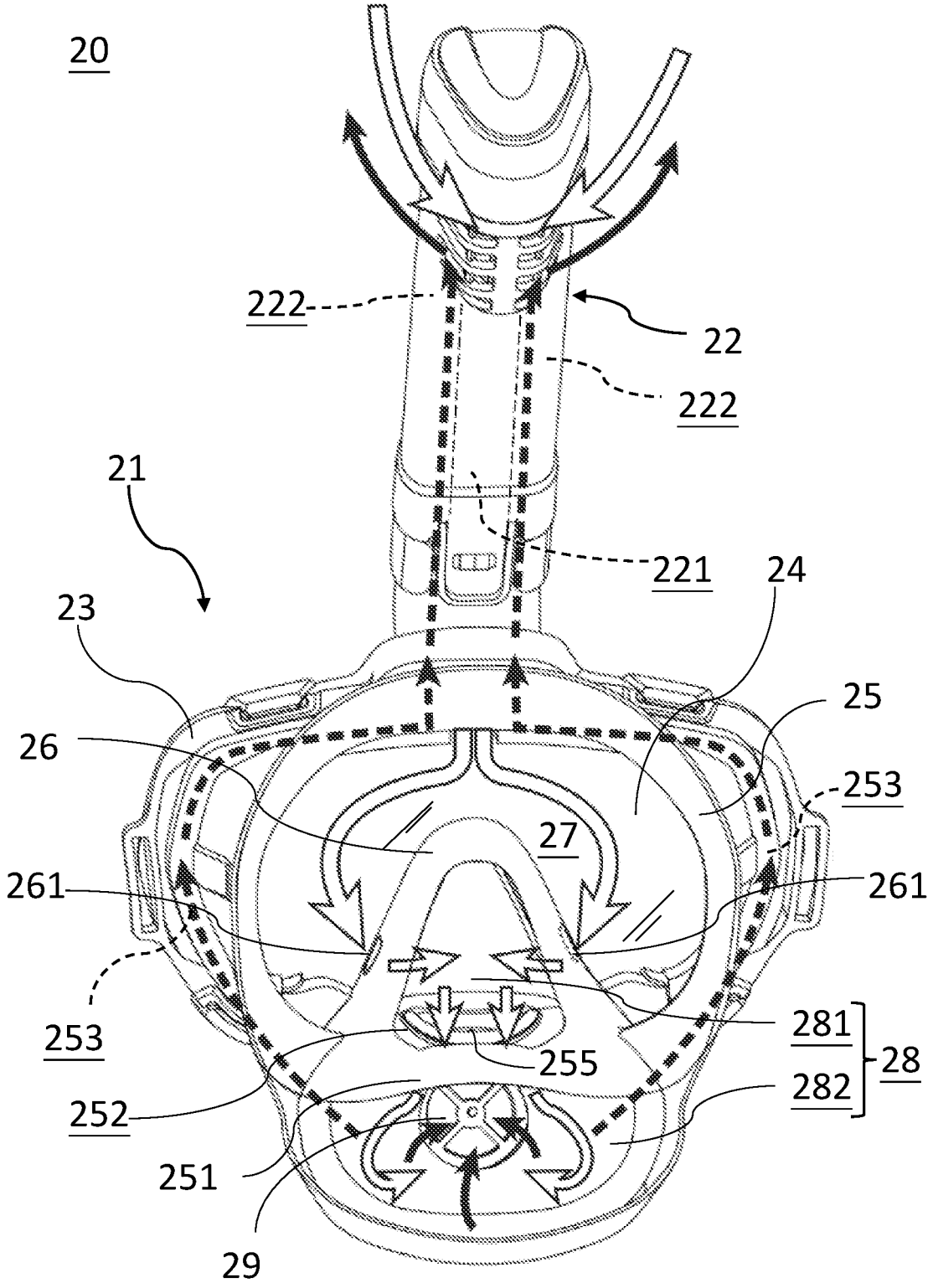
FIG. 2 is the airflow schematic diagram of the second embodiment of the present invention.

FIG. 2 is a schematic diagram of an individual description of the second embodiment. Similar to the first embodiment, the mask 20 includes a breathing tube 22 with the intake conduit 221 and the exhaust conduit 222 formed therein. The intake passage is provided with a first one-way valve 261, which only allows inhalation air to enter from the upper chamber 27 to the nasal chamber 281 unidirectionally. Preferably, the first one-way valve 261 is located on the partition 26, and more preferably, a second one-way valve (not shown) can be provided on the exhaust passage to ensure that the exhaled air is unidirectionally discharged through the exhaust passage from the lower chamber 28, and to further prevent the dirty air accumulated in the exhaust passage from flowing back into the mouth chamber 282.

In this embodiment, the exhaust passage communicates with the mouth chamber 282. At least one opening 252 is provided on the bridge 251 (the number and shape of the openings are not limited). The bridge 251 further includes a third one-way valve 255 which is disposed on the opening 252. That is to say, when the user wears the mask 20, fluid is only allowed to flow from the nasal chamber 281 to the mouth chamber 282 through the third one-way valve 255. As shown by the hollow airflow lines of FIG. 2, when the nose inhales, fresh air will enter from the intake conduit 221 of the breathing tube 22, pass through the upper chamber 27, and enter the nasal chamber 281 through the first one-way valve 261 for the nose to inhale; when the mouth inhales, the fresh air in the nasal chamber 281 will pass through the third one-way valve 255 and enter the mouth chamber 282 for the mouth to inhale. As shown by the solid airflow lines of FIG. 2, when the nose exhales, the dirty air will first enter the mouth chamber 282 through the third one-way valve 255, then pass through the exhaust tunnel 253 independently formed on the periphery of the upper chamber 27, then the exhaust conduit 122 provided in the breathing tube 12, and is discharged outwards. The exhaust tunnel 253 is, for example, formed by the waterproof sealing skirt 25 and the periphery of the lens 24. When the mouth exhales, the dirty air will pass from the above-mentioned exhaust tunnel 253, then the exhaust conduit 222 provided in the breathing tube 22, and is discharged outwards. And when the mouth exhales heavily, because of the blocking of the bridge 251 and the third one-way valve 255, the accumulated water in the mouth chamber 282 will be discharged through the purge valve 29, and will not splash back into the nasal chamber 281, thereby making the nose absolutely dry and comfortable. Therefore, the user can freely use the nose or mouth to inhale or exhale. Moreover, because the space of the mouth chamber 282 is very small, more preferably, because the position of the purge valve 29 can face the user's mouth, this design can allow the user to overcome the water pressure and easily drain water without needing to surface, thereby saving more energy.

Figure 3A:
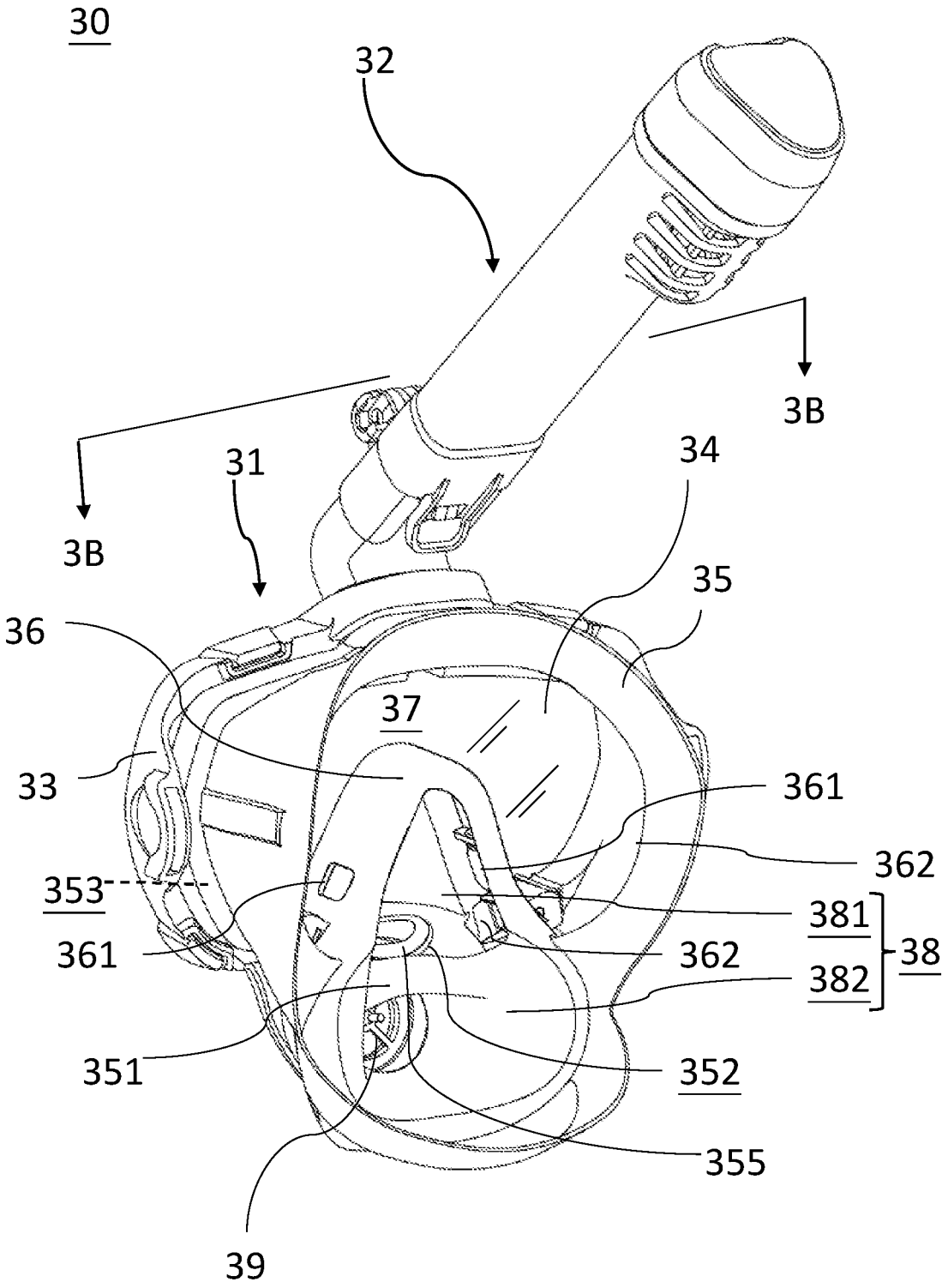
FIG. 3A is a three-dimensional schematic diagram of a third embodiment of the present invention.
Figure 3B:
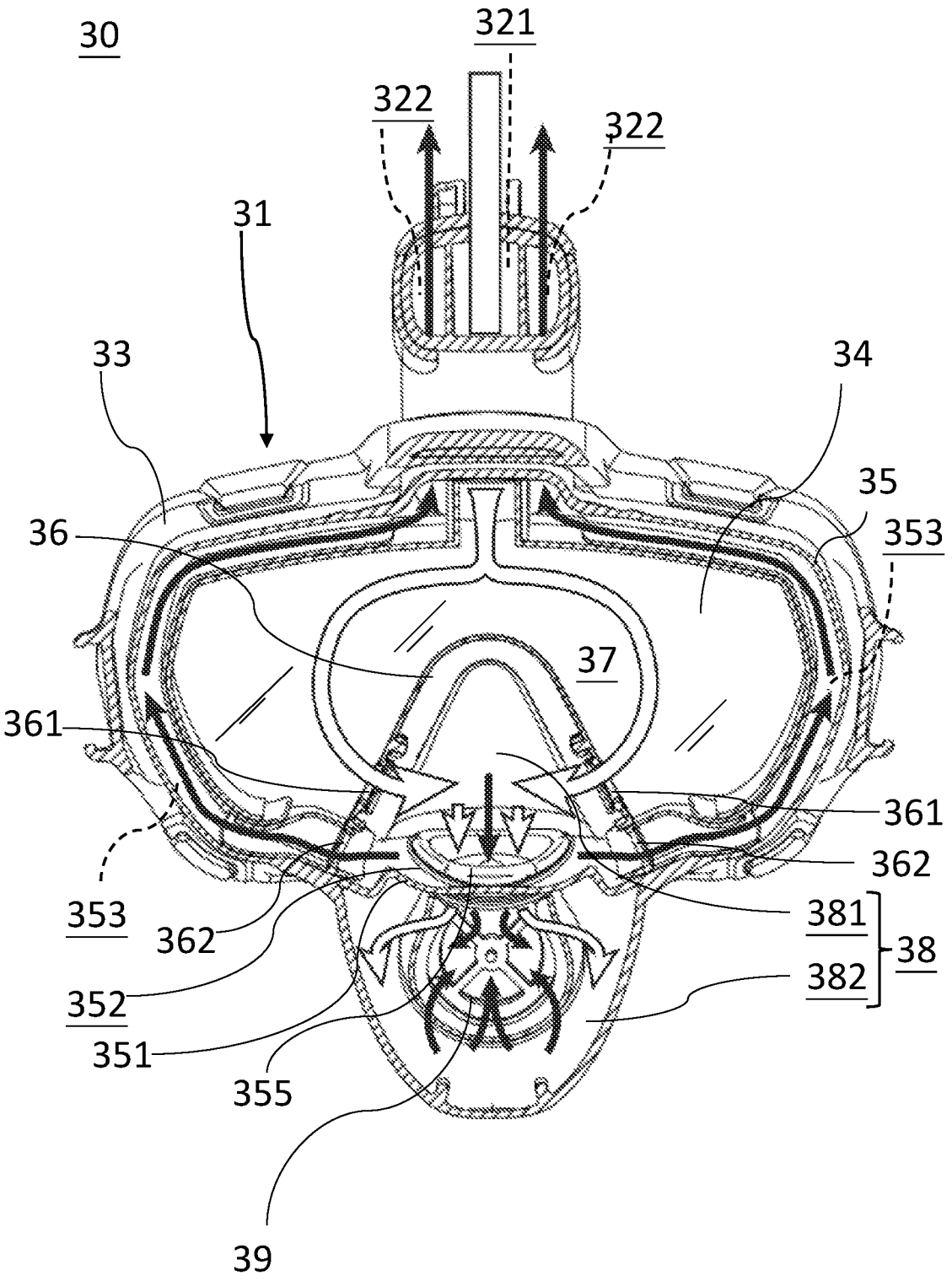
FIG. 3B is a coronal cross-sectional view obtained from line 3B-3B of FIG. 3A, showing the intake and exhaust airflows.

FIGS. 3A and 3B are schematic illustrations of the third embodiment. Similar to the second embodiment, the mask 30 includes a breathing tube 32 with the intake conduit 321 and the exhaust conduit 322 formed therein. The intake passage is provided with a first one-way valve 361, which only allows inhalation air to enter from the upper chamber 37 to the nasal chamber 381 unidirectionally. Preferably, the first one-way valve 361 is located on the partition 36, and more preferably, the exhaust passage can be provided with a second one-way valve 362 to ensure that the exhaled air is unidirectionally discharged through the exhaust passage from the lower chamber 38, and to further prevent the dirty air accumulated in the exhaust passage from flowing back into the nasal chamber 381.

In this embodiment, the exhaust passage communicates with the nasal chamber 381. The bridge 351 is provided with at least one opening 352 (the number and shape of the openings are not limited), and the bridge 351 further includes a third one-way valve 355, which is disposed on the opening 352 to only allow the inhaled air to enter from the nasal chamber 381 into the mouth chamber 382 unidirectionally. That is to say, when the user puts on the mask 20, fluid is only allowed to flow from the nasal chamber 381 to the mouth chamber 382 through the third one-way valve 355. As shown by the hollow airflow lines of FIG. 3B, when the nose inhales, fresh air will enter from the intake conduit 321 of the breathing tube 32, pass through the upper chamber 37, and enter the nasal chamber 381 through the first one-way valve 361 for the nose to inhale; when the mouth inhales, the fresh air in the nasal chamber 381 will pass through the third one-way valve 355 and enter the mouth chamber 382 for the mouth to inhale. As shown by the solid airflow lines of FIG. 3B, when the nose exhales, the dirty air will pass through the exhaust tunnel 353 which is independently located on the periphery of the upper chamber 27, then through the exhaust conduit provided in the breathing tube 32, and is discharge outwards; when the mouth exhales, the dirty air is blocked by the third one-way valve 355 and will not return to the nasal chamber 381. And when the mouth exhales heavily, because of the blocking of the bridge 351 and the third one-way valve 355, the accumulated water in the mouth chamber 382 will be discharged through the purge valve 39 directly, and will not splash back into the nasal chamber 381, thereby making the nose area dry and comfortable. In this embodiment, therefore, the user can arbitrarily use the nose to inhale and exhale, and use the mouth to inhale. Furthermore, in this embodiment, the dirty air exhaled from the mouth will not return to the nasal chamber 381 to appear in the next inhalation cycle. And also, when in water, facing the water pressure and the blocking of the third one-way valve 355, the mouth cannot effectively participate in exhalation. This causes the nose to be able to inhale in purer fresh air, so that the user will subconsciously use the nose to breathe, thereby improves the durability and safety of snorkeling activities. Moreover, because the space of mouth chamber 382 is very small, and more preferably, because the purge valve 39 can be just located in front of the user's mouth, the design of this embodiment can allow the user to overcome water pressure, easily carry out draining in the water without needing to surface, thereby being more energy-saving.

Figure 4A:
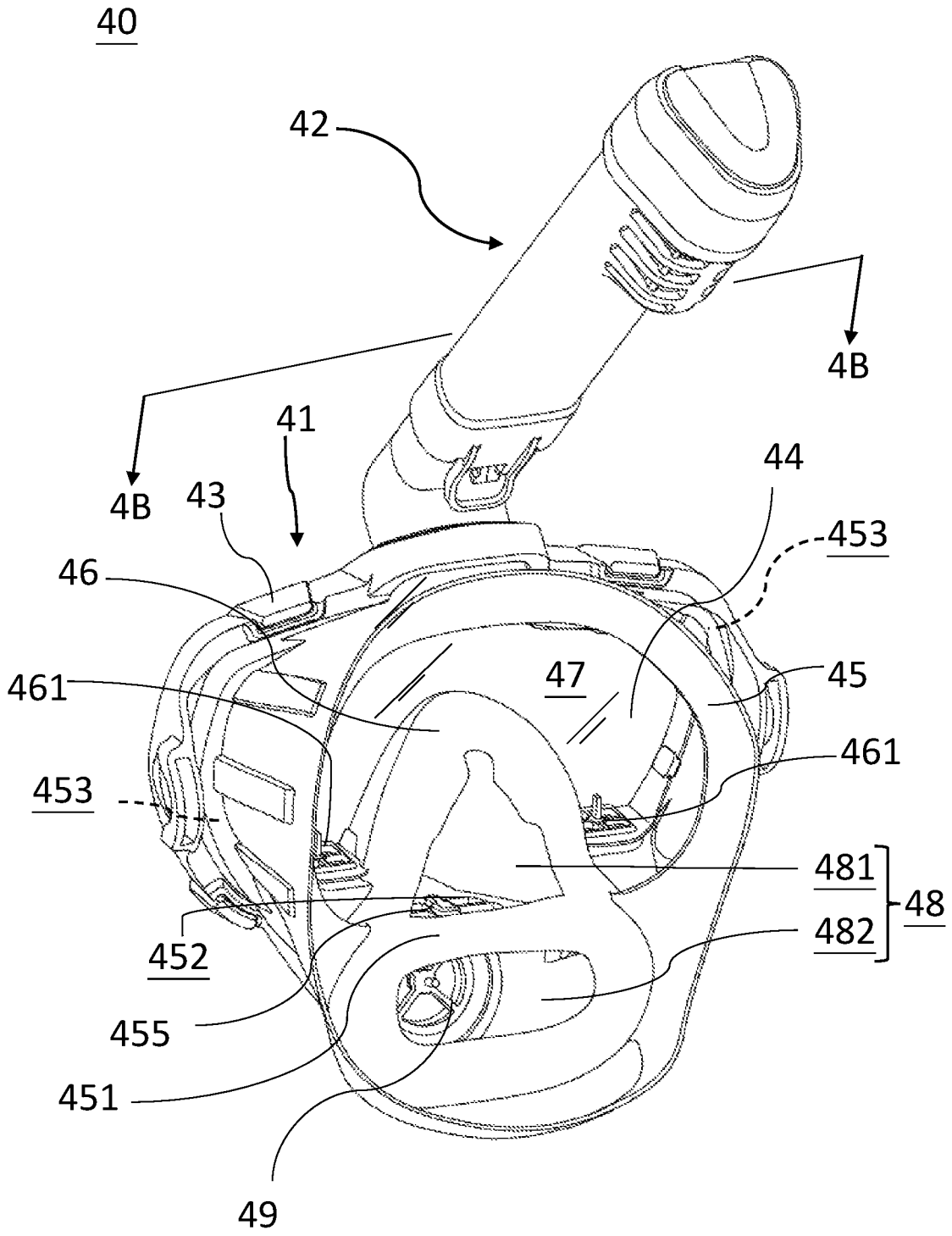
FIG. 4A is a three-dimensional schematic diagram of a fourth embodiment of the present invention.
Figure 4B:
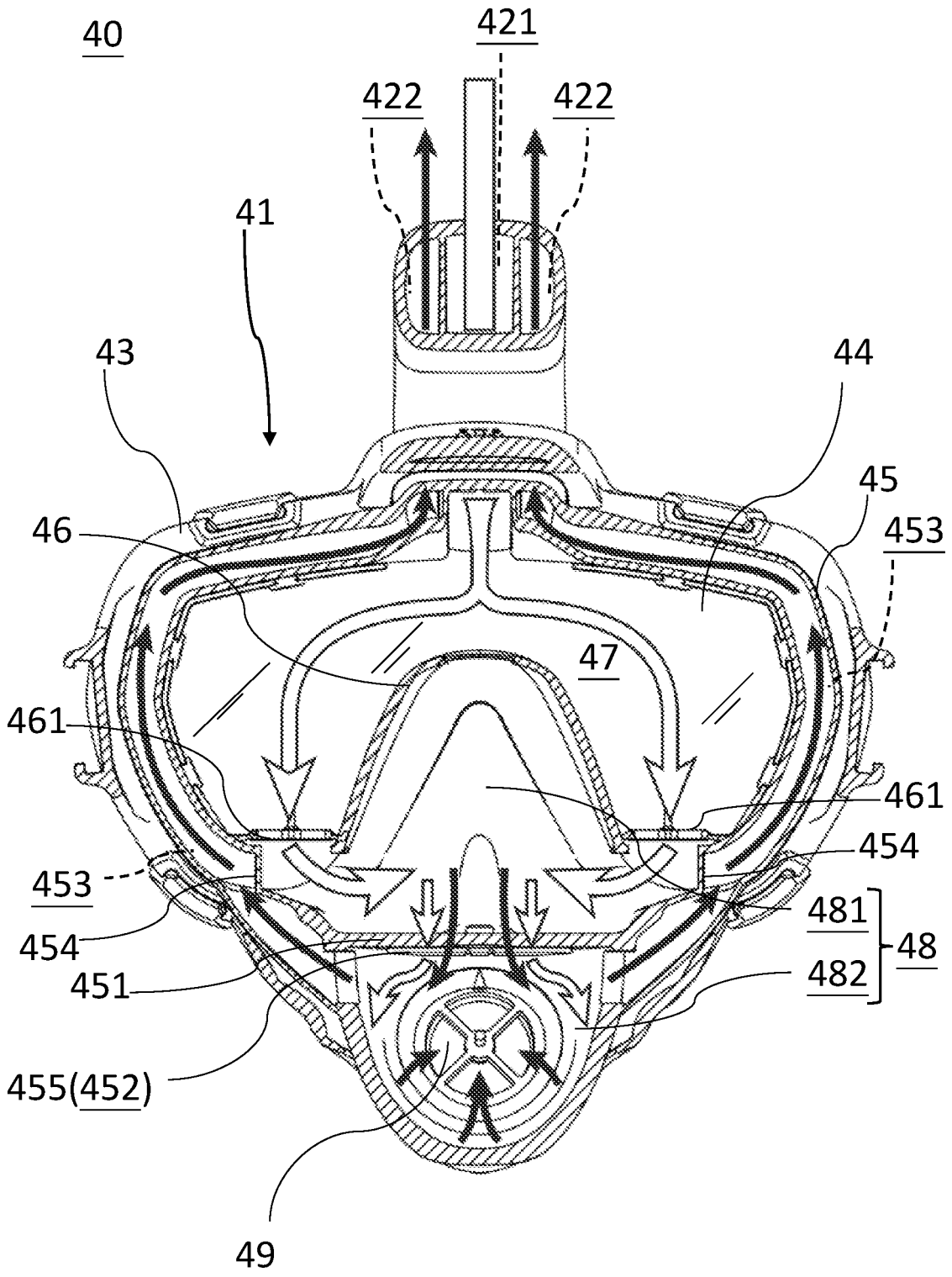
FIG. 4B is a coronal cross-sectional view obtained from line 4B-4B of FIG. 4A, showing the intake and exhaust flow.

FIGS. 4A and 4B are schematic illustrations of the fourth embodiment. Similar to the second embodiment, the mask 40 includes a breathing tube 42 with the intake conduit 421 and the exhaust conduit 422 formed therein. The intake passage is provided with a first one-way valve 461, which only allows inhaled fresh air to enter from the upper chamber 47 to the lower chamber 48 unidirectionally. In this embodiment, the first one-way valve 461 lies on the lower, outer side of the partition 46. More preferably, a second one-way valve (not shown) can be provided on the exhaust passage to ensure that the exhaled air is unidirectionally discharged through the exhaust passage from the lower chamber 48, and to further prevent the dirty air accumulated in the exhaust passage from flowing back into the mouth chamber 482.

In this embodiment, the exhaust passage communicates with the mouth chamber 482. The bridge 451 is provided with at least one opening 452 (the number and shape of the openings are not limited), and the bridge 451 further includes a third one-way valve 455, which is disposed on the opening 452 to allow the inhaled air to unidirectionally enter from the nasal chamber 481 into the mouth chamber 482. That is to say, when the user puts on the mask 40, fluid is only allowed to flow from the nasal chamber 481 to the mouth chamber 482 through the third one-way valve 455. As shown by the hollow airflow lines of FIG. 4B, when the nose inhales, fresh air will enter from the intake conduit 421 of the breathing tube 42, pass through the upper chamber 47, and enter the nasal chamber 481 through the first one-way valve 461 for the nose to inhale; when the mouth inhales, the fresh air in the nasal chamber 481 will pass through the third one-way valve 455 and enter the mouth chamber 482 for the mouth to inhale. As shown by the solid airflow lines of FIG. 4B, when the nose exhales, the dirty air will first enter the mouth chamber 482 through the third one-way valve 455, then pass through the exhaust tunnel 453 independently formed on the periphery of the upper chamber 47, then the exhaust conduit 422 provided in the breathing tube 42, and is discharged outwards. The exhaust tunnel 453 is, for example, formed by the waterproof sealing skirt 45 and the periphery of the lens 44. When the mouth exhales, the dirty air will pass from the above-mentioned exhaust tunnel 453, then the exhaust conduit 422 provided in the breathing tube 42, and is discharged outwards. And when the mouth exhales heavily, because of the blocking of the bridge 451 and the third one-way valve 455, the accumulated water in the mouth chamber 482 will be discharged through the purge valve 49, and will not splash back into the nasal chamber 481, thereby making the nose absolutely dry and comfortable. Therefore, the user can freely use the nose or mouth to inhale or exhale. Moreover, because the space of the mouth chamber 482 is very small, more preferably, because the position of the purge valve 49 can face the user's mouth, this design can allow the user to overcome the water pressure and easily drain water without needing to surface, thereby saving more energy.

In order to prevent the dirty air discharged from the mouth chamber 482 from being mixed into the next inhalation, in this embodiment, the intake passage and the exhaust passage can be further isolated. Specifically, the exhaust passage is provided with a dividing wall 454 at an inlet area thereof, in which the dividing wall is merged and integrally formed with the partition 46 and the bridge 451, so that the exhaled air from the mouth chamber 482 is further isolated from the inhaled air entering the nasal chamber 481.

Figure 5A:
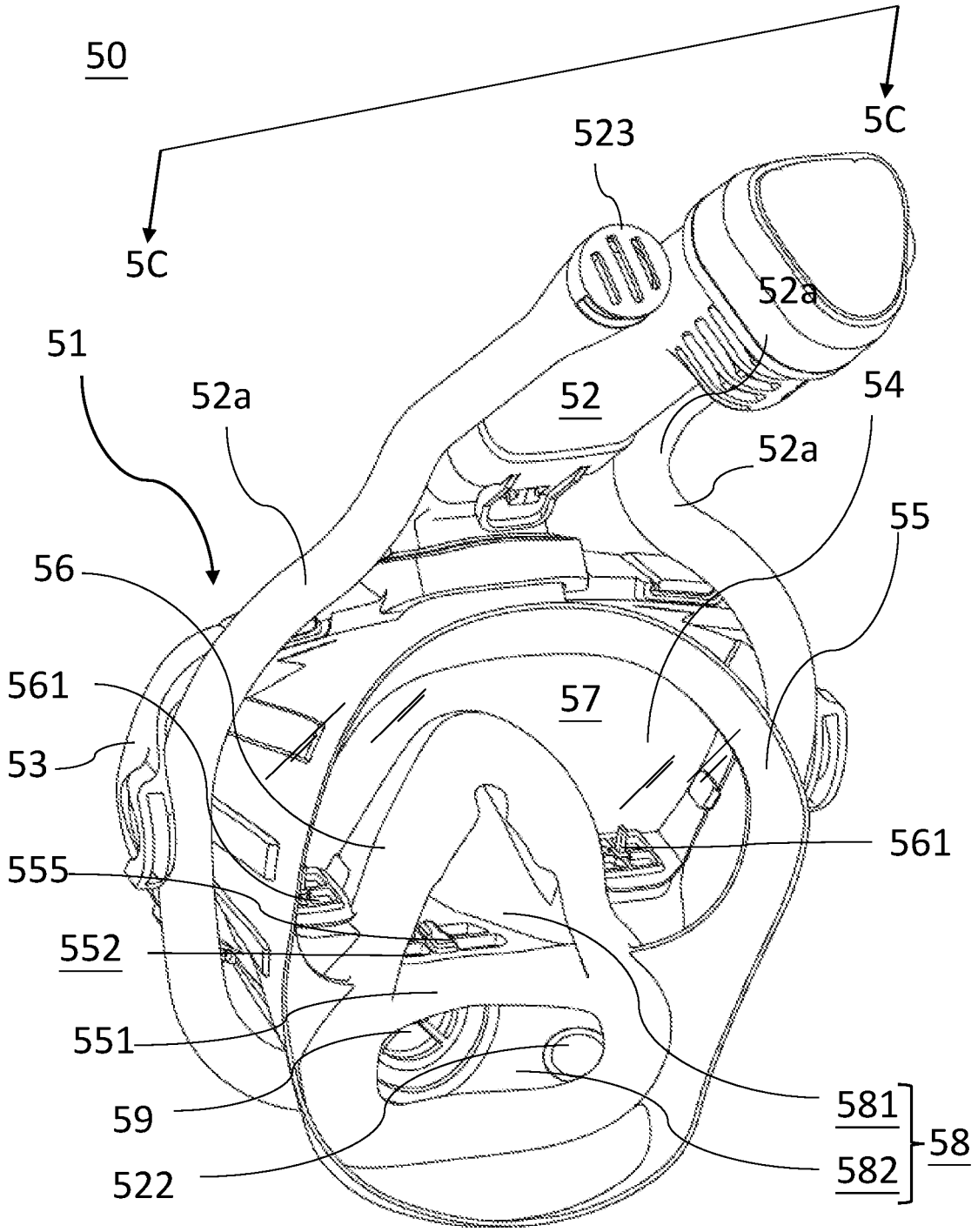
FIG. 5A is a perspective view of a fifth embodiment of the present invention.
Figure 5B:
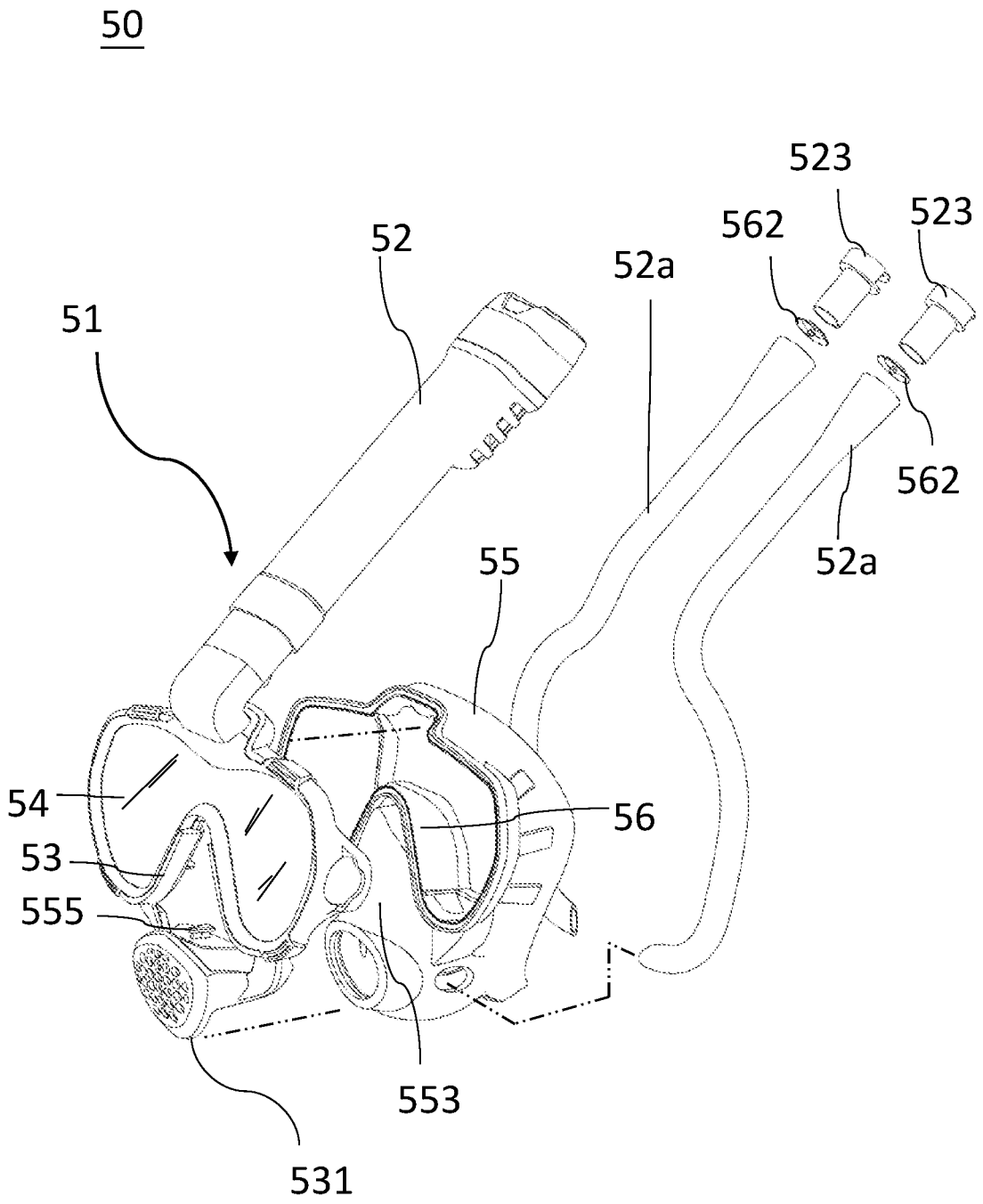
FIG. 5B is a front perspective exploded view of the fifth embodiment of the present invention, in which the purge valve is not shown.
Figure 5C:
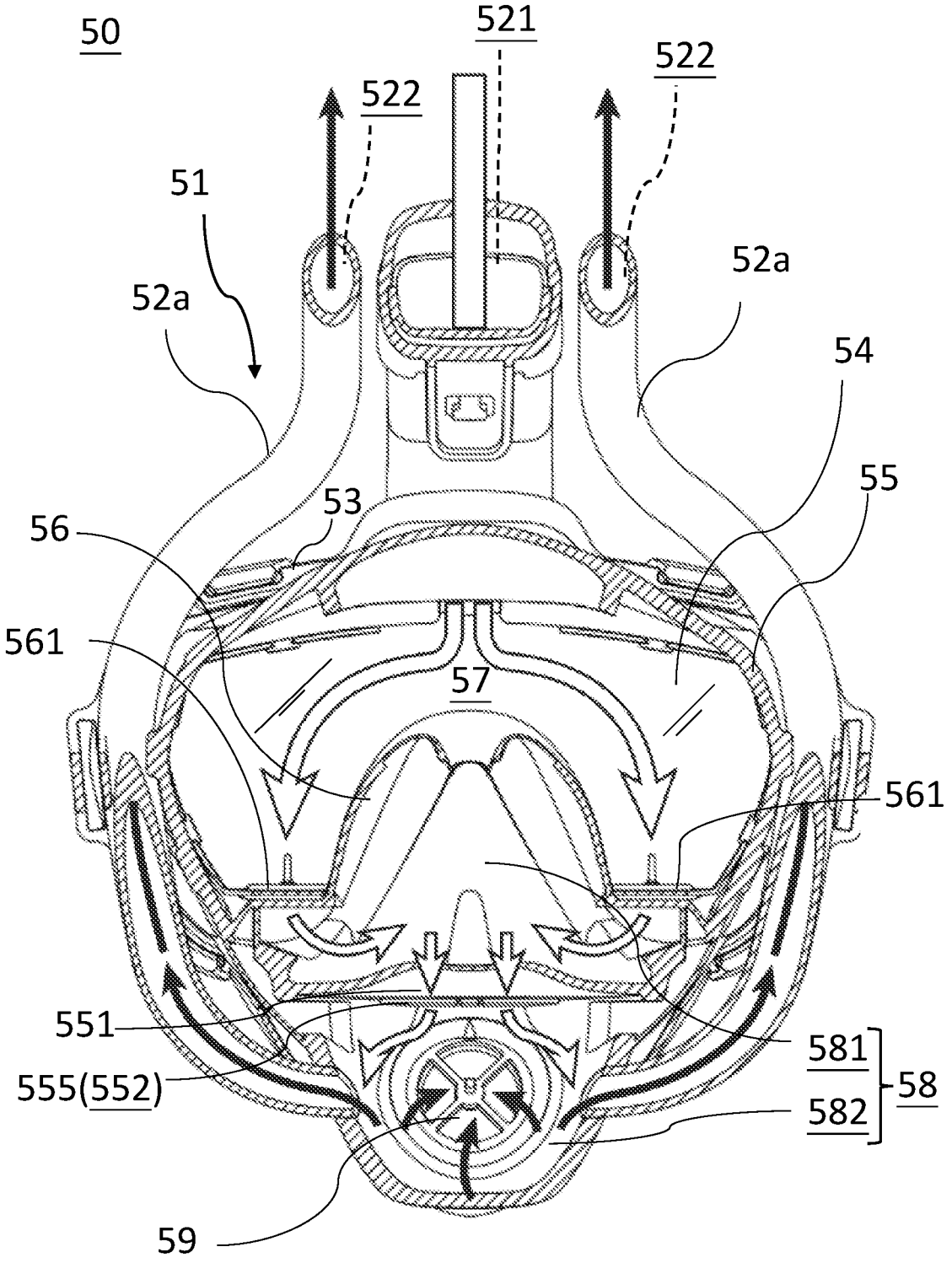
FIG. 5C is a coronal cross-sectional view taken along line 5C-5C of FIG. 5A, showing intake and exhaust airflows.

FIGS. 5A, 5B and 5C are schematic illustrations of the fifth embodiment. The design of the breathing tube of this embodiment is different from those of the previous embodiments. In this embodiment, the mask 50 includes two breathing tubes 52, 52*a*, one of which defines the intake conduit 521, and the other of which defines the exhaust conduit 522. The exhaust conduit 522 extends along the outer contour of the body 51 to be adjacent to the intake conduit 521, and has a lower end being inserted into the mouth chamber 582 in a waterproof manner so as to communicate with the mouth chamber 582. More preferably, the exhaust conduit 522 is interposed between one side of the main frame 51 and the waterproof skirt 55 for better positioning. The intake passage is provided with a first one-way valve 561, which only allows inhalation air to enter from the upper chamber 57 to the nasal chamber 581 unidirectionally. In this embodiment, the first one-way valve 561 lies on the lower, outer side of the partition 56. More preferably, the exhaust passage can be provided with a second one-way valve 562 which is disposed at a top of the exhaust conduit 522 and fixed by the lid 523, so as to allow exhaled air to be unidirectionally discharged from the mouth chamber 582 through the exhaust conduit 522. Of course, an exhaust one-way valve (such as the second one-way valve 362 of the third embodiment, not shown in the figures for illustrating this embodiment) can also be added at the place where the exhaust passage communicates with the mouth chamber 582. This sort of exhaust one-way valve can further prevent the dirty air accumulated in the exhaust passage from flowing back into the mouth chamber 582.

In this embodiment, the exhaust passage communicates with the mouth chamber 582. The bridge 551 is provided with at least one opening 552 (the number and shape of the openings are not limited), and the bridge 551 further includes a third one-way valve 555, which is disposed on the opening 552 to allow the inhaled air to unidirectionally enter from the nasal chamber 581 into the mouth chamber 582. That is to say, when the user puts on the mask 50, fluid is only allowed to flow from the nasal chamber 581 to the mouth chamber 582 through the third one-way valve 555. As shown by the hollow airflow lines of FIG. 5C, when the nose inhales, fresh air will enter from the intake conduit 521 of the breathing tube 52, pass through the upper chamber 57, and enter the nasal chamber 581 through the first one-way valve 561 for the nose to inhale; when the mouth inhales, the fresh air in the nasal chamber 581 will pass through the third one-way valve 555 and enter the mouth chamber 582 for the mouth to inhale. As shown by the solid airflow lines of FIG. 5C, when the nose exhales, the dirty air will first enter the mouth chamber 582 through the third one-way valve 555, then pass through the exhaust conduit 522 independently extending along the outer profile of the body 51 and is discharged outwards. When the mouth exhales, the dirty air will be directly discharged outwards through the above-mentioned exhaust conduit 522. And when the mouth exhales heavily, because of the blocking of the bridge 551 and the third one-way valve 555, the accumulated water in the mouth chamber 582 will be discharged through the purge valve 59, and will not splash back into the nasal chamber 581, thereby making the nose absolutely dry and comfortable. Therefore, the user can freely use the nose or mouth to inhale or exhale. Moreover, because the space of the mouth chamber 582 is very small, more preferably, because the position of the purge valve 59 can face the user's mouth, this design can allow the user to overcome the water pressure and easily drain water without needing to surface, thereby saving more energy. Furthermore, in this embodiment, the intake passage is inside the mask body 51, whereas the exhaust passage is outside the mask body 51, so that the effect of mutual isolation between the intake and exhaust air is much better. Moreover, because the intake conduit 521 in the breathing tube 52 does not need to share a space with the exhaust conduit 522, the diameter of the intake conduit 521 in the breathing tube 52 can be enlarged, as opposed to the previous embodiments, so that the intake volume of fresh air becomes much larger, thereby the user's inhalation becomes much easier as well.

Comprehensively and conclusively learned from the above-mentioned embodiments, in fact, the key point of the present invention is the structure of the body 11, 21, 31, 42, 51 of the breathable mask 10, 20, 30, 40, 50, which comprises: a main frame 13, 23, 33, 43, 53, a lens 14, 24, 34, 44, 54, embedded in the main frame, a waterproof sealing skirt 15, 25, 35, 45, 55, at least partially connected to the main frame 13, 23, 33, 43, 53 and the lens 14, 24, 34, 44, 54. The waterproof sealing skirt 15, 25, 35, 45, 55 is suitable for fitting on a user's face and has a partition 16, 26, 26, 46, 56, which divides the interior of the body 11, 21, 31, 42, 51 into an upper chamber 17, 27, 37, 47, 57 and the lower chamber 18, 28, 38, 48, 58. When the user puts on the mask 10, 20, 30, 40, 50, the partition 16, 26, 26, 46, 56 is located on the user's nose, and the user's eyes are accommodated in the upper chambers 17, 27, 37, 47, 57, and the user's nose and mouth are accommodated in the lower chambers 18, 28, 38, 48, 58. More importantly, the waterproof sealing skirt 15, 25, 35, 45, 55 also includes a bridge 151, 252, 351, 451, 551 disposed across the lower chamber 18, 28, 38, 48, 58, thereby dividing the lower chambers 18, 28, 38, 48, 58 into a nasal chamber 181, 281, 381, 481, 581 and a mouth chamber 182, 282, 382, 482, 582 located below the nasal chamber. After wearing the mask, the user's nose is accommodated in the nasal chambers 181, 281, 381, 481, 581, and the user's mouth is accommodated in the mouth chambers 182, 282, 382, 482, 582. The nasal chambers 181, 281, 381, 481, 581 and the mouth chambers 182, 282, 382, 482, 582 are suitable for fluid communication through the bridges 151, 252, 351, 451, 551, preferably, for fluid communication unidirectionally from the nasal chamber to the mouth chamber.

It can be understood that the physiological structure of the human body has some established natural mechanisms, which automatically tend to the environment with clean air and avoid the environment with dirty air. Therefore, under the water surface, if the nose cannot breathe freely, and only the mouth can, in order to maintain life, the physiological mechanism will automatically lift the soft palate to block nasal breathing and switch to mouth breathing without training. Under the nature mechanism, this is why the traditional snorkeling equipment uses a diving mask to cover the eyes and nose, prohibiting nose breathing, and uses an independent snorkel to allow the user to breathe alone through the snorkel through the mouth. Of course, if the nose and mouth can breathe evenly, the user will use the nose or mouth to breathe freely, but usually only one of them can be selected as the main method, and the two cannot be used at the same time. It is another natural tendency in the anatomy. Furthermore, if in an environment, the nose is easier to inhale in fresh air than the mouth, the human brain will subconsciously and naturally order itself to use the nose to breathe (at this time the soft palate is lowered), allowing itself to get a comfortable breathing model containing more oxygen.

Therefore, in any embodiment of the above-mentioned design, although it is feasible to use mouth or nose to breathe, because the nasal chamber is the first chamber where fresh air enters the mask and is provided to the human body for inhalation, and there is almost no dirty air exhaled from the mouth to remain in the previous breathing cycle, inhaling through the nose will naturally become the most comfortable choice for the user. This further highlights the advantages of the present invention. Taking the fourth and fifth embodiments as an example, if the user inhales through the nose, regardless of using the mouth or the nose to exhale, the dirty air that has not been discharged will be stored in the mouth chamber and the exhaust passage. Also, the intake and exhaust passages are not communicated or shared at all, so the fresh air coming in from the outside will be provided to the user for inhalation with almost 100% purity. This is an effect that the prior art cannot achieve.

Furthermore, it should be noted that the exhaust conduits, exhaust tunnels or exhaust passages of the above-mentioned embodiments are best designed with bilateral symmetry, but for the sake of clarity and conciseness, only one of them is selected for illustration and proposition, and its number is, however, not limited. In addition, the present invention divides the lower chamber into a nasal chamber and a mouth chamber with a bridge, which can be used in any form of full-face masks. In this application, only one type is selected for illustration (as specifically seen in FIG. 5B). For a greater detail as an example for illustration, the main frame 53 and the lens 54 only cover the user's eyes, whereas the user's nose and mouth are mainly housed by the waterproof sealing skirt 55. And an additional mouth frame 531 independent of the main frame 53 and the lens 54 is further provided, whereas the purge valve 59 is placed behind the mouth frame 531, and the soft nose covering portion 553 protrudes outward between the main frame 53 and mouth frame 531. Any style changed based on the concept of the present invention, such as the intake, exhaust conduit, exhaust passage, the first or second one-way valve, their number, type, position, and the number and style of lenses (one piece or left-right separated), or, the communication between the exhaust passage and the nasal chamber or the mouth chamber should not be restricted, as long as it is the structure of the intake and exhaust diversion, regardless of the type of mask. All of them are within the scope of the present invention, and should not be misinterpreted to limit the claims set forth in the last paragraph.

What is claimed is:

1. A breathable mask comprising a body and a breathing tube, the breathing tube being in fluid communication with an interior of the body, and including an intake conduit and an exhaust conduit independent of each other; the body including:

a main frame;

a lens fitted in the main frame;

a waterproof sealing skirt, at least partially fitted with the main frame and the lens, the waterproof sealing skirt being suitable for fitting on a user's face; wherein the waterproof sealing skirt has a partition to separate the interior of the body into an upper chamber and a lower chamber, whereby when the user wears the mask through a fastening device, the partition is seated on a nose of the user, eyes of the user are housed in the upper chamber, and the nose of the user and mouth of the user are accommodated in the lower chamber;

an intake passage formed from the intake conduit to the lower chamber;

an exhaust passage formed from the lower chamber to the exhaust conduit;

characterized in that: the waterproof sealing skirt further includes a bridge, formed across the lower chamber, whereby dividing the lower chamber into a nasal chamber and a mouth chamber below the nasal chamber, when the user puts on the mask, the user's nose is accommodated in the nasal chamber, and the user's mouth is accommodated in the mouth chamber, wherein the intake passage is in fluid communication with the nasal chamber, the exhaust passage is in fluid communication with the mouth chamber, and the nasal chamber and the mouth chamber are suitably in fluid communication with each other through the bridge;

wherein the intake passage is provided with a first one-way valve to unidirectionally provide inhaled air from the upper chamber into the nasal chamber; wherein the first one-way valve is disposed on the partition; wherein the bridge is formed with an opening so that the nasal chamber is in fluid communication with the mouth chamber therethrough; and wherein the bridge further includes a third one-way valve disposed on the opening to provide the inhaled air from the nasal chamber to enter the mouth chamber unidirectionally.

2. The breathable mask according to claim 1, wherein the exhaust passage is provided with a second one-way valve to provide exhaled air to be unidirectionally discharged from the mouth chamber along the exhaust passage.

3. A breathable mask, comprising a body and a breathing tube, the breathing tube being in fluid communication with an interior of the body, and including an intake conduit and an exhaust conduit independent of each other; the body including:

a main frame;

a lens fitted in the main frame;

a waterproof sealing skirt, at least partially fitted with the main frame and the lens, the waterproof sealing skirt being suitable for fitting on a user's face; wherein the waterproof sealing skirt has a partition to separate the interior of the body into an upper chamber and a lower chamber, whereby when the user wears the mask through a fastening device, the partition is seated on a nose of the user, eyes of the user are housed in the upper chamber, and the nose of the user and mouth of the user are accommodated in the lower chamber;

an intake passage formed from the intake conduit to the lower chamber;

an exhaust passage formed from the lower chamber to the exhaust conduit;

wherein the waterproof sealing skirt further includes a bridge, formed across the lower chamber, whereby dividing the lower chamber into a nasal chamber and a mouth chamber below the nasal chamber, when the user puts on the mask, the user's nose is accommodated in the nasal chamber, and the user's mouth is accommodated in the mouth chamber, wherein the exhaust passage is in fluid communication with the nasal chamber, and the nasal chamber and the mouth chamber are suitably in fluid communication with each other through the bridge; wherein the intake passage is provided with a first one-way valve to unidirectionally provide inhaled air from the upper chamber into the nasal chamber;

wherein the exhaust passage communicates with the nasal chamber; and wherein the bridge is provided with an opening, and further comprises a third one-way valve provided on the opening to provide the inhaled air from the nasal chamber to unidirectionally enter the mouth chamber.

4. The breathable mask according to claim 3, wherein the exhaust passage is provided with a second one-way valve to provide exhaled air from the nasal chamber to be discharged outward along the exhaust passage.

5. A breathable mask, comprising a body and a breathing tube, the breathing tube being in fluid communication with an interior of the body, and including an intake conduit and an exhaust conduit independent of each other; the body including:

a main frame;

a lens fitted in the main frame;

a waterproof sealing skirt, at least partially fitted with the main frame and the lens, the waterproof sealing skirt being suitable for fitting on a user's face; wherein the waterproof sealing skirt has a partition to separate the interior of the body into an upper chamber and a lower chamber, whereby when the user wears the mask through a fastening device, the partition is seated on a nose of the user, eyes of the user are housed in the upper chamber, and the nose of the user and mouth of the user are accommodated in the lower chamber;

an intake passage formed from the intake conduit to the lower chamber;

an exhaust passage formed from the lower chamber to the exhaust conduit;

wherein the waterproof sealing skirt further includes a bridge, formed across the lower chamber, whereby dividing the lower chamber into a nasal chamber and a mouth chamber below the nasal chamber, when the user puts on the mask, the user's nose is accommodated in the nasal chamber, and the user's mouth is accommodated in the mouth chamber, wherein the intake passage is in fluid communication with the nasal chamber, the exhaust passage is in fluid communication with the mouth chamber, and the nasal chamber and the mouth chamber are suitably in fluid communication with each other through the bridge; wherein the intake passage is provided with a first one-way valve to unidirectionally provide inhaled air from the upper chamber into the nasal chamber;

wherein the exhaust passage communicates with the mouth chamber, and the first one-way valve lies on a lower, outer side of the partition; wherein the exhaust passage is provided with a dividing wall at an inlet area thereof, in which the dividing wall is merged and integrally formed with the partition and the bridge, so that exhaled air from the mouth chamber is further isolated from the inhaled air entering the nasal chamber; and wherein the bridge is provided with an opening, and further comprises a third one-way valve provided on the opening to provide the inhaled air from the nasal chamber to unidirectionally enter the mouth chamber.

6. The breathable mask according to claim 5, wherein the exhaust passage is provided with a second one-way valve, which provides the exhaled air to be unidirectionally discharged from the mouth chamber along the exhaust passage.

* * * * *